US006430845B1

(12) United States Patent
Noda

(10) Patent No.: US 6,430,845 B1
(45) Date of Patent: Aug. 13, 2002

(54) FOOTWEAR

(76) Inventor: Kozo Noda, 693-21, Wakashiba-machi, Ryugasaki-shi, Ibaraki-ken (JP)

( * ) Notice: Subject to any disclaimer, the term of this patent is extended or adjusted under 35 U.S.C. 154(b) by 0 days.

(21) Appl. No.: 09/774,651

(22) Filed: Feb. 1, 2001

(30) Foreign Application Priority Data

Aug. 30, 2000 (JP) ..... 2000-260458

(51) Int. Cl.[7] ..... A43B 3/24; A43B 3/12
(52) U.S. Cl. ..... 36/100; 36/101; 36/11.5
(58) Field of Search ..... 36/100, 101, 15, 36/11.5

(56) References Cited

U.S. PATENT DOCUMENTS 3,863,272 A 2/1975 Guille
3,902,259 A * 9/1975 Cracco
4,439,935 A * 4/1984 Kelly
4,887,369 A * 12/1989 Bailey et al.
4,974,344 A 12/1990 Ching
5,339,543 A * 8/1994 Lin
5,822,888 A * 10/1998 Terry
5,992,058 A * 11/1999 Jneid
6,212,797 B1 * 4/2001 Merry et al.

* cited by examiner

*Primary Examiner*—Ted Kavanaugh
(74) *Attorney, Agent, or Firm*—Kanesaka & Takeuchi

(57) ABSTRACT

A footwear has an inner footwear body with a sole pad, and an outer footwear body with a sole pad rest. Each of the inner and outer footwear bodies has an instep member, and the inner footwear body has an adjustable joining band, so that the inner footwear body can be separably united on the outer footwear body by the adjustable joining band. When the inner footwear body is soiled, it can easily be removed and washed or exchanged for new one, thus to keep the footwear clean.

7 Claims, 8 Drawing Sheets

FOOTWEAR

BACKGROUND OF THE INVENTION

1. Field of the Invention:

This invention relates to footwear such as mules, scuffs and sandals.

2. Description of the Prior Art:

There are usually provided mules and scuffs for common use in hotels, restaurants, hospitals and meeting places, so that anyone may use. Since the mules and scuffs provided in such public facilities are used by all sorts and conditions of people, it is necessary to maintain good hygiene of the footwear.

There has been proposed an idea of keeping the footwear clean, in which a cover sheet is removably attached onto an insole by use of a flat fastener, so that the cover sheet can be replaced when soiled (Japanese Utility Model Public Disclosures Nos. SHO 57-186504(A); SHO 59-132504(A); and HEI 1-169103(A)).

Although this prior art measure may maintain hygiene of the insole of the footwear, it has a disadvantage such that the inside of an instep member or vamp cannot be kept clean even if the cover sheet is replaced.

Another measure in which an inner cover attached detachably to a part of a mule, at which the wearer's foot touches, the mule is replaced when soiled (Japanese Utility Model Registration No. 3008071(B)).

This second measure may possibly overcome the shortcoming of the former measure noted above, but the work disadvantageously becomes onerous where the inner cover is replaced.

OBJECT OF THE INVENTION

This invention is made to eliminate the drawbacks suffered by the conventional footwear as described above and has an object to provide convenient footwear capable of being always kept clean.

Another object of the invention is to provide hygienic footwear such as mules, scuffs and sandals, which is easy to handle and especially convenient for use in public facilities such as hotels, restaurants, hospitals and meeting places.

Still another object of the invention is to provide footwear such as mules, scuffs and sandals, which can be continuously kept clean over a long period of time and used economically and rationally.

SUMMARY OF THE INVENTION

To attain the object described above according to this invention, there is provided footwear comprising an inner footwear body detachably laid on an outer footwear body. The inner footwear body includes a sole pad and an instep member. The sole pad is provided on its lower surface with a first inner joining means. The instep member is provided on its outer surface with a second inner joining means.

The aforesaid outer footwear body includes a sole pad rest having an adjustable retaining member. The sole pad rest is provided on its upper surface with a first outer joining means capable of separably engaging with the aforesaid first inner joining means of the sole pad of the inner footwear body. The adjustable retaining member includes a first fastening means, and a second fastening means, which engages with the first fastening means through a fastener means. The adjustable retaining member is provided on its inner side with a second outer joining means capable of separably engaging with the aforesaid second inner joining means on the instep member of the inner footwear body.

The sole pad of the inner footwear body is joined onto the sole pad rest and secured with the first inner and outer joining means. The adjustable retaining member of the outer footwear body is securely joined to the outer surface of the instep member of the inner footwear body by the second inner and outer joining means.

As the first and second fastening means, a flat fastener may be used, so as to separably engage the flat fastener, the respective counterparts of the first inner and outer joining means and the second inner and outer joining means with ease.

The whole bottom surface of the inner footwear body and the whole upper surface of the outer footwear body may be joined respectively with the flat fastener so as to make the sole pad flat.

To hold the inner footwear body in place on the outer footwear body, there may be formed an anti-slippage rib along the peripheral portion of the sole pad of the outer footwear body. With this anti-slippage rib, the inner footwear body is prevented from slipping out of place in use.

The instep member of the inner footwear body may be formed of an arch-shaped instep member with front and rear swelling rims astride the first inner joining means so as to be soft to the touch. The instep member of the inner footwear body may be made of a composition of cloth and foam material. In this case, the part which the instep of a wearer touches may be lined with the cloth, and the swelling rims of the instep member may be formed by folding back the both end parts of the cloth inwardly so as to make a double-ply foam softly swelling form of foam material. The double-ply rim of the swelling rim has moderate elasticity to be soft to the touch, thus to prevent the foot of the wearer from being grazed.

The first adjustable retaining member may be formed in a strap longer than that of the second retaining member to be placed over the greater part of instep of the wearer. With this structure, the footwear can be worn stably and improved in appearance.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
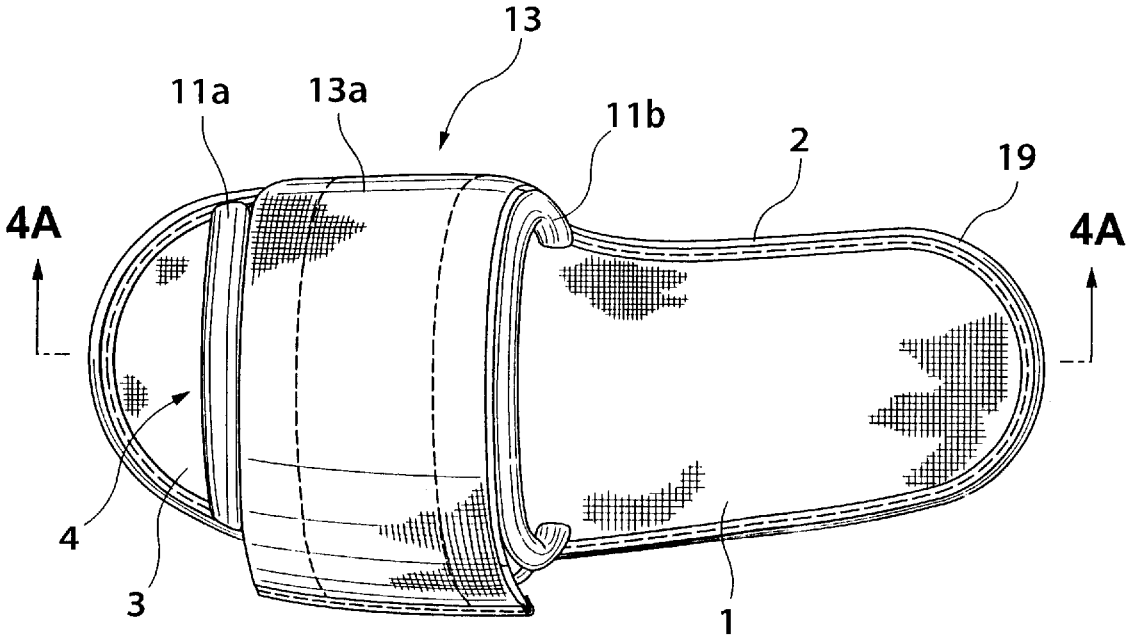
FIG. 1 is a plan view showing one embodiment of footwear according to the present invention.
Figure 2:
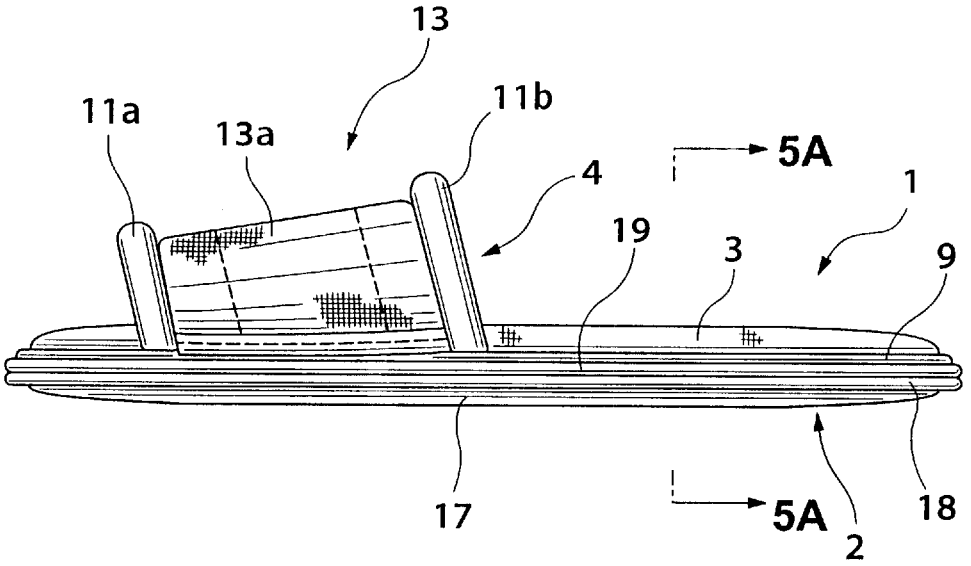
FIG. 2 is a front view showing the footwear of FIG. 1.
Figure 3:
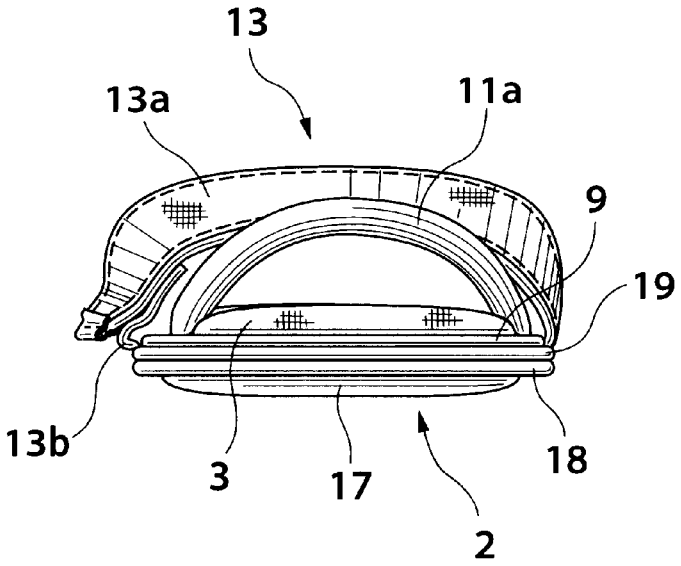
FIG. 3 is a left side view showing the footwear of FIG. 1.
Figure 6:
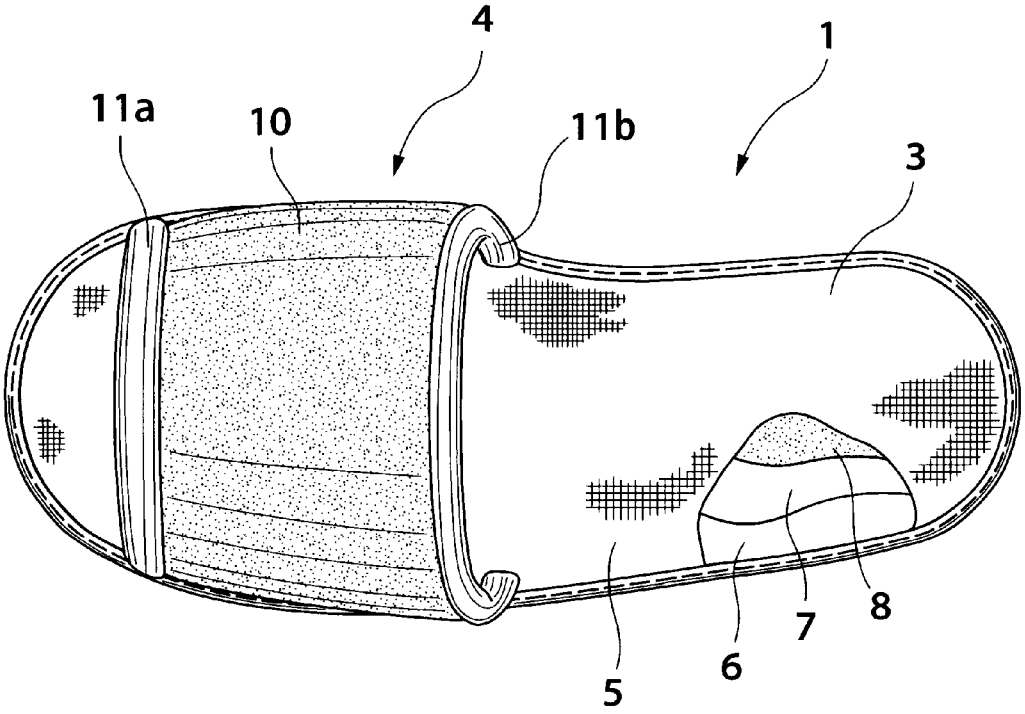
FIG. 6 is a partial cutaway plan view of an inner footwear body of the footwear of the invention.

One preferred embodiment of the footwear according to the present invention will be described hereinafter with reference to the accompanying drawings. In the illustrated embodiment, the footwear of the invention is a mule by way of example, but the footwear of the invention should not be understood as being limited thereto. It is needless to say that the present invention can be applied to various types of footwear including not only mules, but also scuffs, sandals, slippers and shoes.

As shown in FIG. 1 through FIG. 5A, the mule shown herein as one example of the footwear of the invention comprises an inner footwear body 1 and an outer footwear body 2 on which the inner footwear body 1 is placed. That is, the mule of the invention is formed of a double sole structure.

As shown in FIG. 4A through FIG. 8, the inner footwear body 1 includes a sole pad 3 and an instep member 4. In this embodiment, the sole pad 3 is made of a composition of cotton cloth 5 such as pile weave textile, a foam layer 6 of urethane or the like having elasticity, a plate-like core 7, and a first inner joining member 8.

The cotton cloth 5 is laid on the core 7. The foam layer 6 is placed between the cotton cloth 5 and the core 7, so that the core 7 is covered up with the foam layer 6. The first inner joining member 8 is attached to the lower surface of the sole pad 3. As the first inner joining member 8, a flat fastener such as Magic Tape (r) and VELCRO Fastener (r) may be used. The sole pad 3 is provided around the periphery thereof with a hem 9.

The instep member 4 is made of a strap formed of cotton cloth 5 and foam material 6 having elasticity. The cotton cloth 5 is located at the inner side of the instep member 4, which the instep of a wearer touches. As shown in FIG. 3 and FIGS. 4A–4C, the instep member 4 is formed in an arch (semicircle) spanning widthward over the sole pad 3, so as to receive the instep of the wearer thereinside.

On the upper surface of the foam material 6 of the instep member 4, there is provided a second inner joining member 10 formed of a flat fastener similar to that of the first inner joining member 8. The second inner joining member 10 extends from one end (lower end in FIG. 6) of the instep member 4 to the other end thereof so as to cover up the whole outside surface of the instep member 4.

The instep member 4 is provided on its front and rear edges with front and rear swelling rims 11a and 11b astride the second inner joining means 10. Thus, the instep member 4 has a channel-like concave 4*a* defined by the front and rear swelling rims 11*a* and 11*b,* so that an adjustable retaining member 13, which will be described later in detail, is fitted in position within the concave 4*a* and prevented from slipping out of place.

Figure 4A:
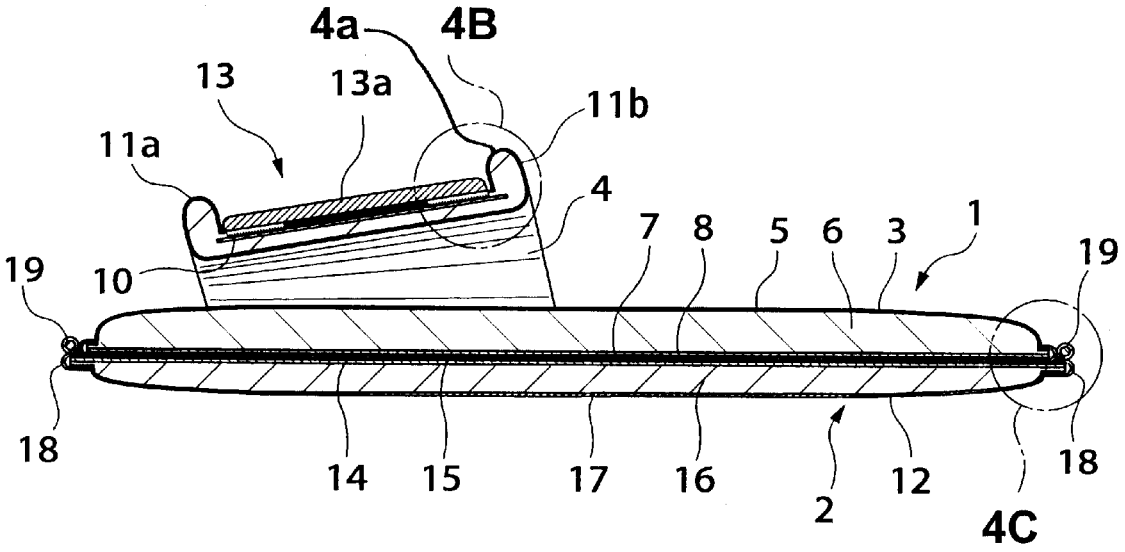
FIG. 4A is a sectional view of the footwear taken along the line 4A—4A in FIG. 1.
Figure 4B:
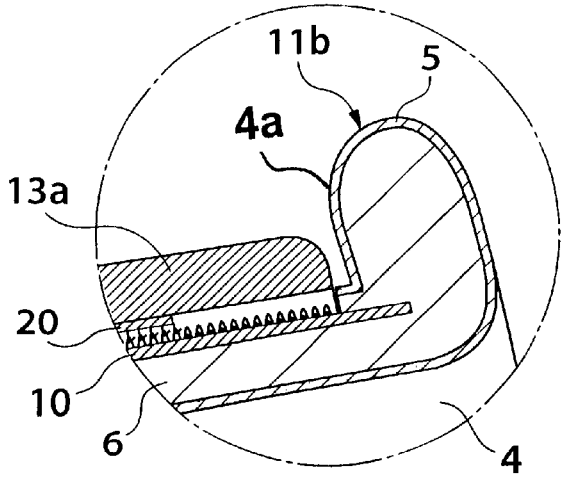
FIG. 4B is an enlarged view showing a part 4B in FIG. 4A.
Figure 4C:
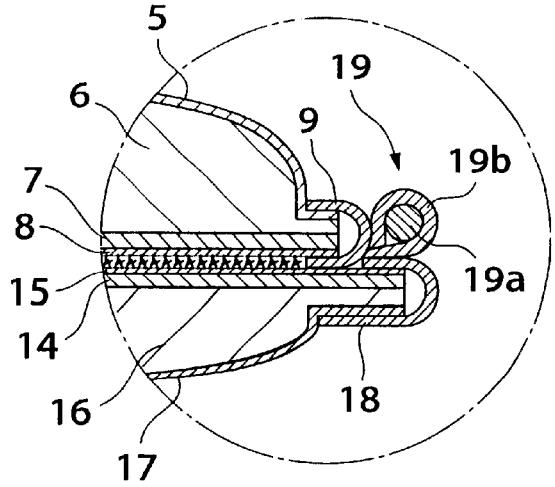
FIG. 4C is an enlarged view showing a part 4C in FIG. 4A.

Each of the swelling rims 11*a* and 11*a* of the instep member 4 is formed by folding back the both end parts of the composition of the cloth 5 and foam material 6 toward the inside of the foam material, as shown in FIG. 4B. To be more specific, the swelling rims 11*a* and 11*b* are formed by folding back the front and rear end parts of the instep member 4 inwardly so as to make a double-ply softly swelling form of foam material as illustrated. Accordingly, the front and rear swelling rims 11*a* and 11*b* are elastic and soft to the touch and difficult to deform even when used over a long period of time. Consequently, the footwear very-fitting and comfortable to wear can be produced.

Next, the outer footwear body 2 will be described with reference to mainly FIGS. 4A–4C, FIGS. 5A–5B and FIGS. 9–13.

The outer footwear body 2 includes a sole pad rest 12 and the adjustable retaining member 13 touched on above briefly. The sole pad rest 12 comprises a plate-like core 14, a first outer joining member 15, a foam layer 16 of urethane or the like having elasticity, and a bottom member 17.

The first outer joining member 15, which is laid on the whole upper surface of the core 14, may be made of a flat fastener such as Magic Tape (r) and VELCRO Fastener (r) similarly to the aforementioned first inner joining member 8 of the inner footwear body 1.

The bottom member 17 is placed below and united to the core 14 through the foam layer 16 placed therebetween. That is, the foam layer 16 is laid over the bottom member 17, and the core 14 is laid over the bottom member 17.

Figure 5A:
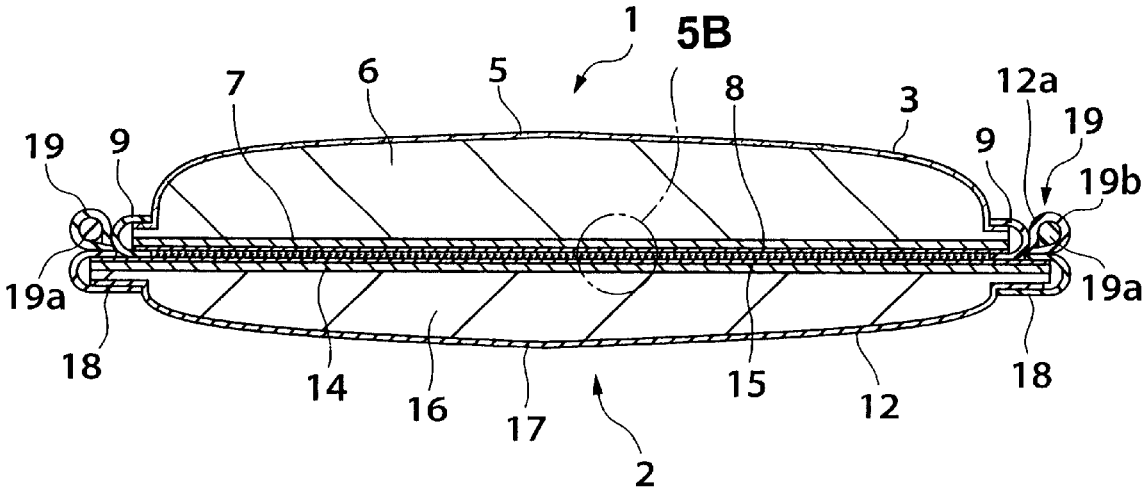
FIG. 5A is a sectional view of the footwear taken along the line 5A—5A in FIG. 2.
Figure 5B:
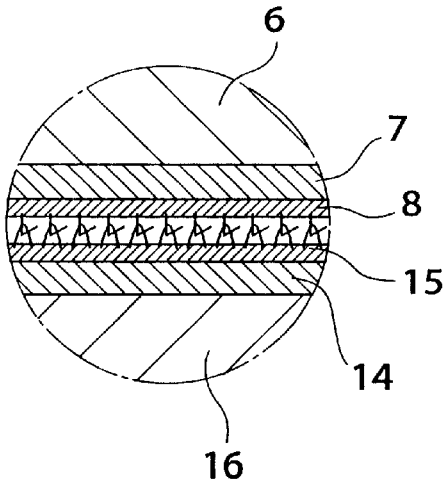
FIG. 5B is an enlarged view showing a part 5B in FIG. 5A.
Figure 7:
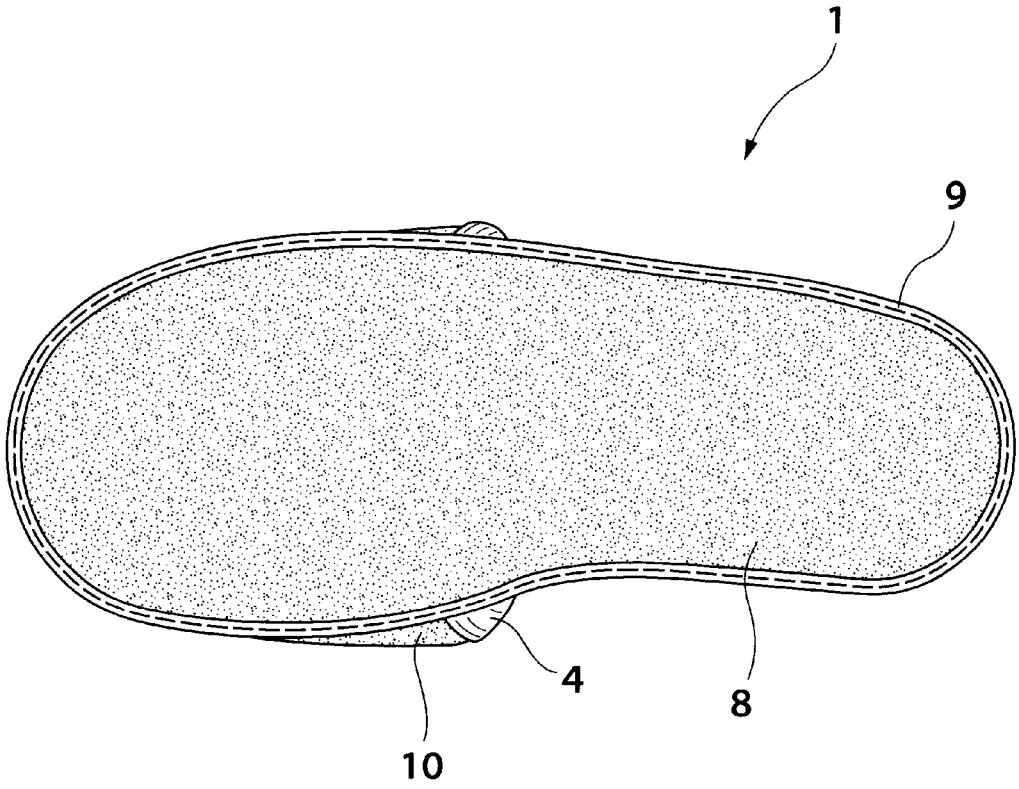
FIG. 7 is a bottom view showing the inner footwear body of the footwear of the invention.
Figure 8:
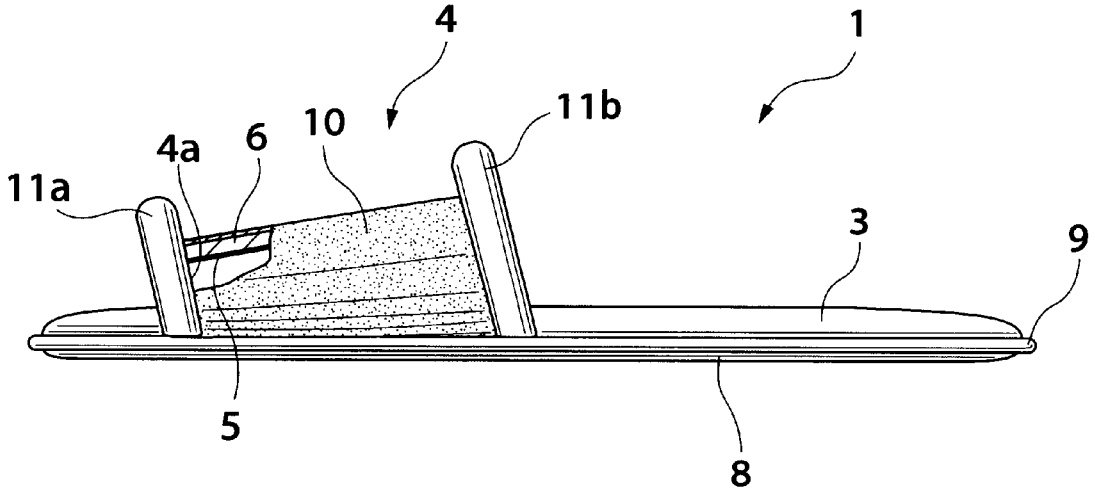
FIG. 8 is a partial cutaway front view of the inner footwear body of the footwear of the invention.
Figure 9:
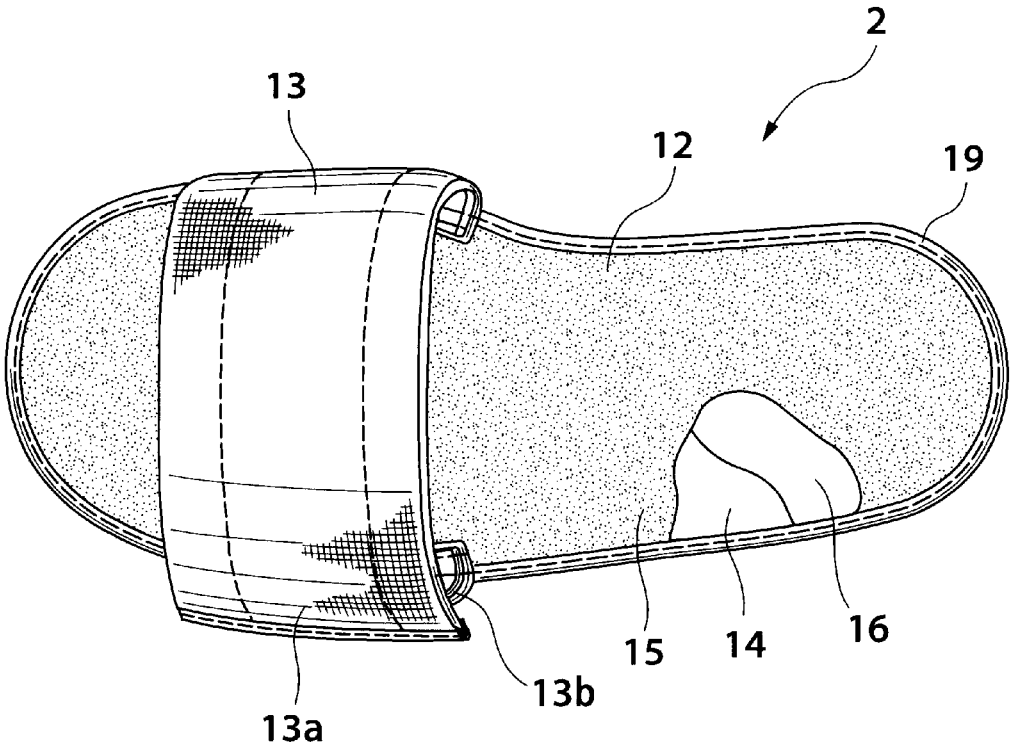
FIG. 9 is a partial cutaway plan view of the outer footwear body of the footwear of the invention.
Figure 10:
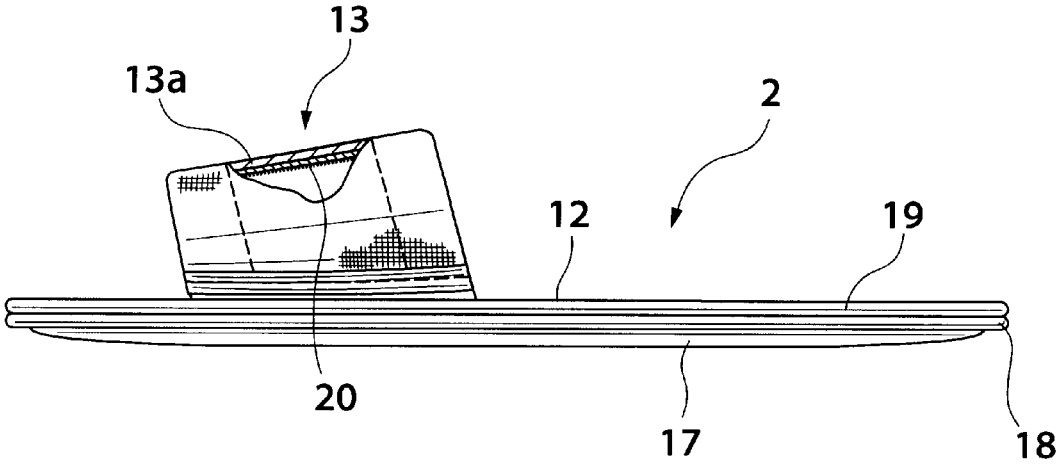
FIG. 10 is a partial cutaway front view of the outer footwear body of the footwear of the invention.
Figure 11:
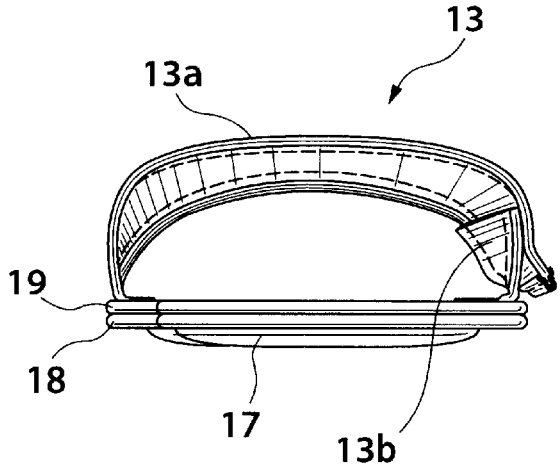
FIG. 11 is a side view showing the outer footwear body of the footwear of the invention.

The sole pad rest 12 is provided around the periphery thereof with a hem 18. Along the peripheral portion of the sole pad rest 12, an anti-slippage rib 19 is formed above the hem 18. The anti-slippage rib 19 in the illustrated embodiment is formed of a plastic wire 19*a* and a cover 19*b*. Consequently, the sole pad rest 12 has an upper concave 12*a* defined by the anti-slippage rib 19 as shown in FIG. 5A.

The adjustable retaining member 13 comprises a first retaining strap 13*a* and a second retaining strap 13*b* shorter than the first retaining strap 13*a*. The first retaining strap 13*a* is secured at its one end (lower end in FIG. 12) onto one side edge of the sole pad rest 12, and the second retaining strap 13*b* is secured at its one end (upper end in FIG. 12) onto the other side edge of the sole pad rest 12.

The entire lower surface of the first retaining strap 13*a* is covered with a second outer joining member 20, which may be formed of, for example, a flat fastener. The flat fastener may be the same as that used as the aforementioned first outer joining member 15.

On the upper surface of the second retaining strap 13*b,* there is provided a joining means 21 which may be formed of, for example, a flat fastener similarly to the foregoing. By pressing the free end part of the first retaining strap 13*a* against the joining means 21 of the second retaining strap 13*b,* these joining members are engaged with each other.

The relation between the inner footwear body 1 and the outer footwear body 2 will be described hereinafter.

The inner footwear body 1 is united with the outer footwear body 2 by being pressed thereagainst in such a state that the lower surface of the sole pad 3 of the inner footwear body 1 faces exactly the upper surface of the sole pad rest 12 of the outer footwear body 2. The engagement between the inner footwear body 1 and the outer footwear body 2 is firmly maintained by the engaged flat fasteners of the first inner joining member 8 and the first outer joining member 15. In this state, the adjustable retaining member 13 of the outer footwear body 2 can be fastened on the instep member 4 of the inner footwear body 1. The adjustable retaining member 13 in its fastened state is fitted within the concave 4*a* formed in the instep member 4.

By fastening the free end part of the first retaining strap 13*a* to the joining means 21 of the second retaining strap 13*b*, the instep member 4 is secured in position. In the fastened state, the second outer joining member 20 of the first retaining strap 13*a* can be engaged with the second inner joining member 10 of the instep member 4.

The inner size of the instep member 4 can easily be adjusted in accordance with the joined position of the free end part of the first joining member 13*a* of the instep member 4 relative to the second retaining member 13*b*. In a case of decreasing the inner size of the instep member 4, the joined position of the free end part of the first joining member 13*a* may be shifted downward in FIG. 1.

Since the sole pad rest 12 has the anti-slippage rib 19 formed along the peripheral portion thereof and the concave 12*a* defined by the rib 19, the inner footwear body 1 is securely held in place on the outer footwear body 2 in an immovable state in the lengthwise direction (right-and-left direction in FIG. 1) and the widthwise direction (up-and-down direction in FIG. 1).

The usage of the aforementioned footwear of the invention will be described hereinafter.

Figure 12:
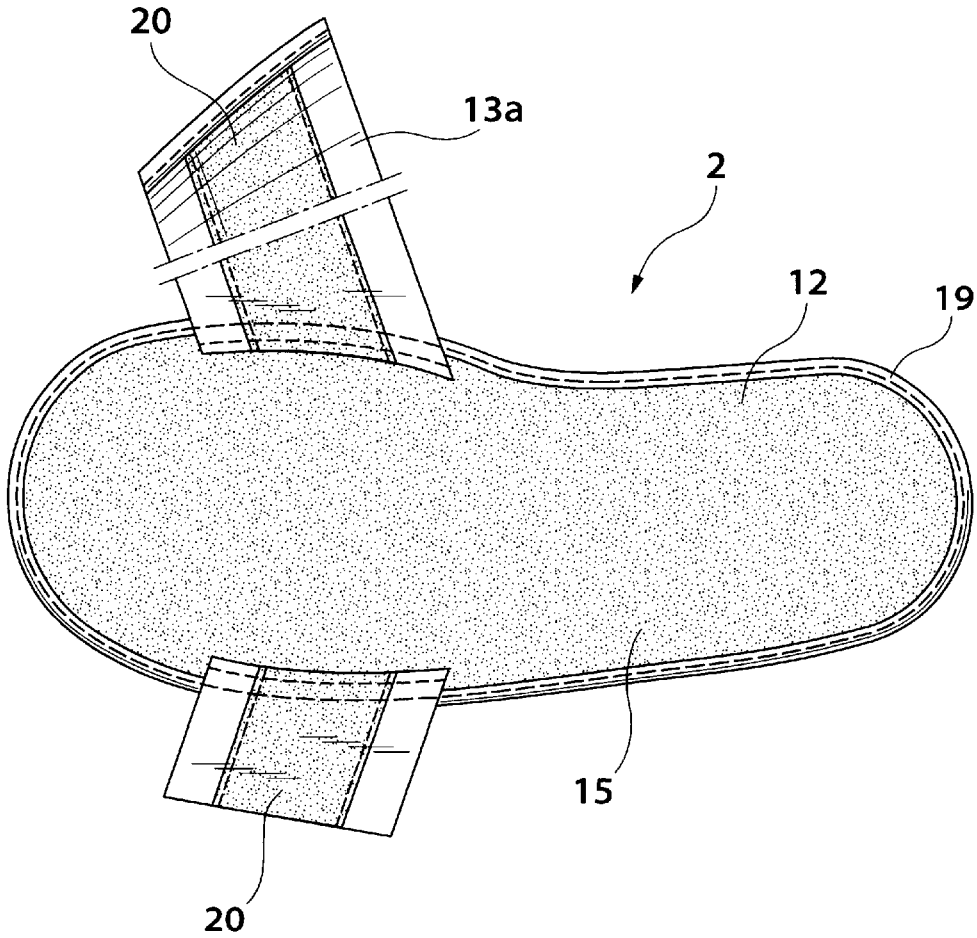
FIG. 12 is a plan view showing the outer footwear body having an adjustable retaining member in an unfastened state.
Figure 13:
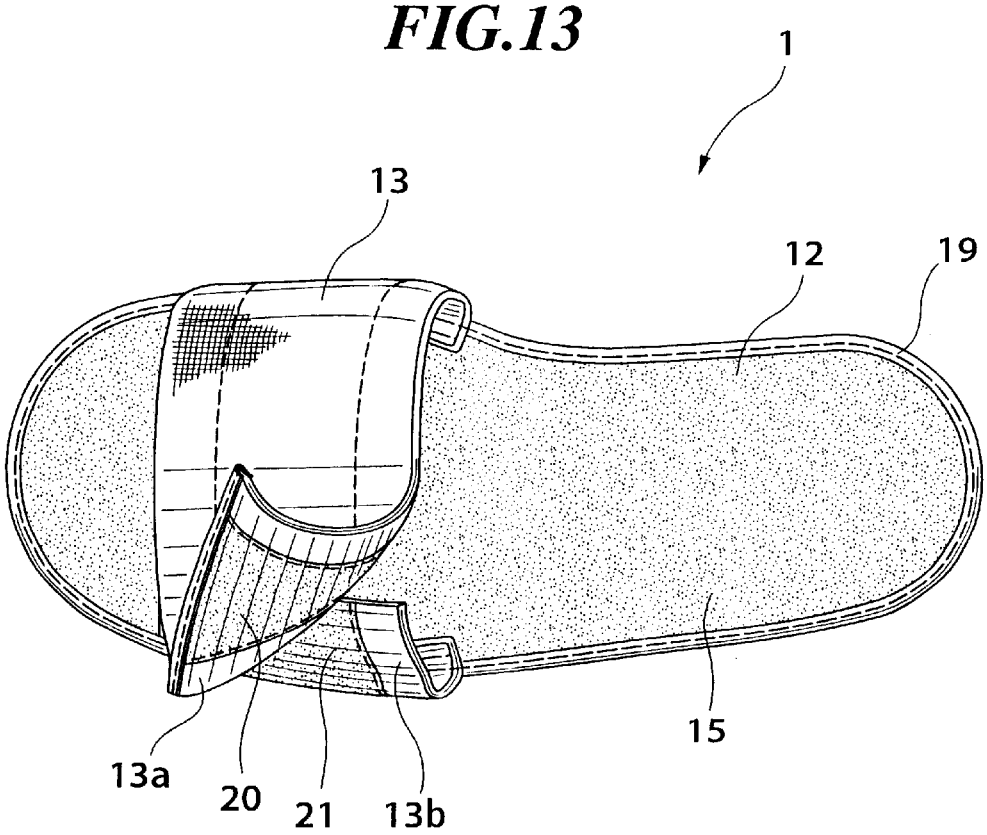
FIG. 13 is a plan view showing the outer footwear body having the adjustable retaining member in a partially unfastened state.

Prior to wearing the footwear, the adjustable retaining member 13 of the outer footwear body 2 is brought into an unfastened spreading state as shown in FIG. 12. First, the sole pad 3 of the inner footwear body 1 is laid on the sole pad rest 12 of the outer footwear body 2 and forcibly pressed against the outer footwear body 2. Consequently, the first inner joining member 8 and the first outer joining member 15 are firmly united to each other, engaging the sole pad 3 and the sole pad rest 12 together.

Next, the wearer puts his foot on the sole pad 3 and slides the tip of toe into the inside of the instep member 4. Then, the first and second retaining straps 13*a* and 13*b* are placed on the instep member 4 so as to be fitted within the concave 4*a* of the instep member 4. Thereafter, the free end part of the first retaining strap 13*a* is permitted to approach the joining means 21 of the second retaining strap 13*b* while adjusting the inside size of the instep member 4. When the instep member 4 comes in touch with the instep of the wearer, the free end part of the first retaining strap 13*a* is fastened with the joining member 21 of the second retaining strap 13*b*. Thus, the first and second retaining straps 13*a* and 13*b* are securely fastened together, while engaging the second inner retaining member 10 and the second outer retaining member 20 with each other as shown in FIG. 4A.

As a result, the tip of toe of the wearer is held firmly by the instep member 4 and the inner footwear body 1. Since the instep of the wearer does not come in direct touch with the first retaining strap 13*a* due to the swelling rims 11*a* and 11*b*, the footwear is comfortable to wear. Furthermore, the inner footwear body 1 is firmly held on the outer footwear body so as not to slip out of place in use.

The footwear can easily be taken off by moving the foot of the wearer relative to the footwear.

When the footwear is soiled, upon unfastening the instep member 4 of the adjustable retaining member 13, the soiled inner footwear body may be removed, and then, washed and reused, or otherwise, replaced with a new inner footwear body.

In general, the footwear such as mules is required to be changed in design according to the purposes for and locations at which it is used and the intended cost of production. According to the invention, since only the inner footwear body 1 can easily be exchanged by preparing a standard outer footwear body, various mules or scuffs designed suitably according to the locations at which they are used can be produced for a hotel and a hospital, for instance. As the countermeasure, there may be prepared one standard type of inner footwear body and a variety of replaceable outer footwear bodies so that various designs of the footwear can be arbitrarily chosen in use.

It is a matter of course that the footwear of the invention is by no means limited to the mules and scuffs. This invention can be applied to sandals, slippers, shoes and any other footwear.

The footwear according to the invention has an advantage in that the adjustable retaining member 13 can be secured in position and prevented from slipping off by forming the swelling rims 11*a* and 11*b* on the front and rear hems of the instep member 4, but of course, the swelling rims are not absolutely necessary to the footwear of this invention.

Figure 14:
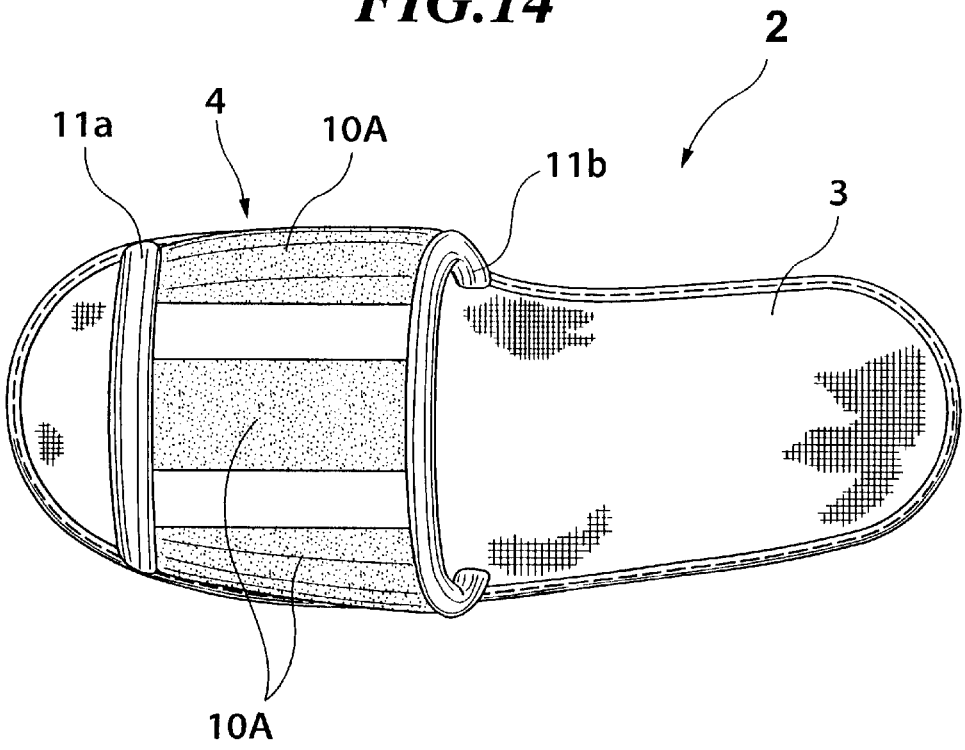
FIG. 14 is a plan view showing another embodiment of the footwear according to this invention.

The footwear of the invention is further advantageous in that it can be very easily worn and taken off because of using the flat fastener as the first inner and outer joining members 8 and 15 and the second inner and outer joining members 10 and 20, respectively. Incidentally, the flat fastener may be disposed entirely or partly on each of the sole pad 3, instep member 4, sole pad rest 12 and adjustable retaining member 13. As shown in FIG. 14, a second joining member 10A is formed of three flat fasteners on the upper part of the instep member 4 of the sole pad 3 in the inner footwear body 1. Similarly, the flat fastener may be divided into some pieces so as to be partly attached to the other joining members 8, 15 and 20, respectively.

The first and second retaining straps 13*a* and 13*b* of the adjustable retaining member 13 may be made equal in length, so that they are joined at the center of the intake strap. Instead of the flat fastener, snap pin and hook may be used.

As is apparent from the foregoing description, since the footwear according to the present invention has the inner footwear body separable from the outer footwear body, the inner footwear can easily be exchanged for new one or washed when being soiled, consequently to keep the footwear clean. The soiled inner footwear body can be conveniently washed and reused economically.

Besides, since the adjustable retaining member enables the inner footwear body to be removably attached to the outer footwear body with ease, the footwear of the invention is easy to handle and can be variously used according to the purposes for which it is used.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A footwear comprising:

an inner footwear body including a sole pad having a first inner joining member on a lower surface thereof, and an instep member fixed to the sole pad and having a second inner joining member on an upper surface thereof, and an outer footwear body including a sole pad rest having, on an upper surface thereof, a first outer joining member facing the first inner joining member and separably engaging therewith so that the sole pad of the inner footwear body separably engages the sole pad rest of the outer footwear body through the first inner and outer joining members; and an adjustable retaining band formed on and attached to the sole pad rest and having a first retaining portion, a second retaining portion with joining means on an outer surface thereof, and a second outer joining member formed on inside surfaces of the first and second retaining portions for separably engaging the second inner joining member of the instep member, a part of the first retaining portion being at least partly located on the second retaining portion so that a part of the second outer joining member formed on the first retaining portion separably engages the joining means of the second retaining portion to firmly engage the first and second retaining portions.

2. A footwear as claimed in claim 1, wherein said first and second joining members of the inner and outer footwear bodies are flat fasteners.

3. A footwear as claimed in claim 2, wherein said sole pad has the lower surface entirely covered with said flat fastener of the first inner joining member of the inner footwear body, and said sole pad rest has the upper surface entirely covered with the flat fastener of the first outer joining member.

4. A footwear as claimed in claim 1, wherein said sole pad rest includes a peripheral portion and an anti-slippage rib formed along the peripheral portion for preventing the inner footwear body from slipping off.

5. A footwear as claimed in claim 1, wherein said instep member has an arch shape and includes peripheral portions extending generally perpendicularly to a longitudinal direction of the inner footwear body, and front and rear swelling rims between which the second inner joining member is located for preventing the adjustable retaining band from slipping off.

6. A footwear as claimed in claim 5, wherein said instep member is made of a strip formed of cloth disposed on a side facing an upper surface of the sole pad, and a foam material laminated on the cloth and having elasticity, said swelling rims having folding back portions of said cloth and foam material folded back inwardly.

7. A footwear as claimed in claim 1, which is a mule having an inner body serving as said inner footwear body and an outer body serving as said outer footwear body.

* * * * *